US007798601B2

(12) United States Patent
Yoshikawa et al.

(10) Patent No.: US 7,798,601 B2
(45) Date of Patent: Sep. 21, 2010

(54) INK JET PRINTING APPARATUS AND METHOD FOR RECOVERING THE SAME

(75) Inventors: Hirokazu Yoshikawa, Kawasaki (JP); Yoshito Mizoguchi, Kawasaki (JP); Daisaku Ide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 11/555,780

(22) Filed: Nov. 2, 2006

(65) Prior Publication Data

US 2007/0103494 A1 May 10, 2007

(30) Foreign Application Priority Data

Nov. 4, 2005 (JP) ..... 2005-321011

(51) Int. Cl.
*B41J 2/165* (2006.01)

(52) U.S. Cl. ..... 347/36; 347/31; 347/14

(58) Field of Classification Search ..... 347/36
See application file for complete search history.

(56) References Cited

U.S. PATENT DOCUMENTS 6,629,750 B2 * 10/2003 Ciordia ..... 347/36
6,860,583 B2 * 3/2005 Cheney et al. ..... 347/35

FOREIGN PATENT DOCUMENTS

| | | |
|---|---|---|
| JP | 7-323574 | 12/1995 |
| JP | 9-030004 | 2/1997 |
| JP | 2003-072106 | 3/2003 |

OTHER PUBLICATIONS

Machine Translation of JP2003072106, Yoshitaka, Mar. 12, 2003.*

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

An amount of deposit in an ink receiving portion can be controlled using an inexpensive configuration which does not require any complicated mechanisms or control and which avoids increasing ink consumption. An ejection control section controls ejecting of ink from a printing section into an ink receiving portion. The printing section has a first ink ejecting portion that ejects ink that accumulates easily in the ink receiving portion and a second ink ejecting portion that ejects ink that is hard to accumulate in the ink receiving portion. The ejection control section changes the landing position, in the ink receiving portion, of the ink ejected from the ink ejecting portions depending on the status of accumulation of the ink in the ink receiving portion.

5 Claims, 8 Drawing Sheets

INK JET PRINTING APPARATUS AND METHOD FOR RECOVERING THE SAME

BACKGROUND OF THE INVENTION

1. Field of the Invention

The present invention relates to a serial scanning ink jet printing apparatus that performs a printing operation by scanning a print head in a direction crossing a direction in which print media are conveyed. In particular, the present invention relates to an ink jet printing apparatus in which in order to maintain the proper ejecting performance of a print head, ink is ejected into an ink receiving portion provided at a position opposite a scan area for the print head, to recover the performance of the print head. The present invention also provides a method for recovering the ink jet printing apparatus.

2. Description of the Related Art

An ink jet printing apparatus outputs an image by ejecting a liquid such as ink from an ink jet print head (hereinafter simply referred to as a print head) onto a print medium in accordance with input image data. Thus, a maintenance technique for maintaining the proper ink ejection state of the print head is a very important factor for forming high quality images. Now, a simple explanation will be given of the major reason for the need for the maintenance of the print head (this operation is hereinafter referred to as a performance recovering operation).

(a) During printing of input image data, ink may be evaporated from nozzles from which ink is not ejected among a plurality of nozzles arranged in the print head. This may make the ink in those nozzles more viscous. In this case, ink cannot be stably ejected by normal ink ejection energy, resulting in improper ejection.

(b) During printing, ink droplets ejected from the nozzles may involve fine ink droplets (which are also called mists) different from main ink droplets that land on the print medium. The fine ink droplets may adhere to the periphery of ink ejection openings in the print head. This may prevent the direct advancement of ejected ink droplets.

(c) When bubbles are present in an ink reservoir in the print head, gas having passed through members constituting the ejection openings or print head may be taken in by the bubbles, which may thus grow. The bubbles may also be expanded by a temperature increase during printing. In this case, an ink supply from an ink tank is hindered by the expanded bubbles, resulting in improper printing.

The following have been known as maintenance techniques for solving the problems in (a) to (c).

(A) In a period or an environment in which ink is not ejected, an operation of ejecting a predetermined amount of ink is preformed which is different from an ink ejecting operation for forming an image on a print medium. This allows ink having become more viscous in the nozzle to be discharged. This operation is hereinafter referred to as preliminary ejection.

(B) The number of ink droplet ejections from the ejection openings is counted. If the count exceeds a predetermined value, a rubber blade or the like is used to sweep a surface (hereinafter referred to as an ejection opening formed surface) of the ink jet print head on which the ejection openings are formed. This removes ink adhering to the ejection opening formed surface. This operation is hereinafter referred to as wiping.

(C) A recovery operation is performed by using a pump to suck ink out of the nozzle ejection openings to discharge ink from the nozzles. This operation is hereinafter referred to as suction recovery. For an ink jet printing apparatus in which the print head and the ink tank can be separated from each other and in which the ink tank is replaceable, the suction recovering operation is also performed after replacement of the ink tank.

In one of these recovery operations, that is, preliminary ejection, particularly preliminary ejection during a printing operation, ink is ejected into a cap that can seal the ejection opening formed surface or a preliminary ejection receiving portion provided opposite a scan path for the print head. In this case, the cap is held at an appropriate distance from the print head (at a lowered position).

On the other hand, the cap plays such a role as to keep the ejection opening formed surface of the ink jet print head sealed in order to prevent the ejection opening formed surface from being dried. The cap is also used for a pressurizing recovery operation of applying air pressure to the inside of the nozzle to discharge ink or for the above suction recovery operation. The suction recovery operation maintains the cap at a position (elevated position) where it seals the ejection opening formed surface to receive ink ejected from the print head.

Thus, to execute preliminary ejection on the cap, it is necessary to lower the cap by an appropriate distance from the ejection opening formed surface of the print head. Ink collected in the cap as a result of preliminary ejection also needs to be discharged during a printing operation. Moreover, ink scattering during preliminary ejection may result in, for example, contamination of the cap and its surroundings. With these inconveniences taken into account, a configuration is more advantageous which preliminarily ejects ink into an ink receiving portion in which only an opening with a given space is formed. This configuration is more advantageous because of its simplified mechanisms and control compared to the configuration that preliminarily ejects ink into the cap.

If an ink receiving portion is used to receive preliminarily ejected ink, it is generally configured so that ejected ink collected in the ink receiving portion is held by a waste ink absorbing portion provided opposite (inside) the ink receiving portion. A channel through which the ink ejected into the ink receiving portion is guided to the waste ink absorbing portion is shaped so as not to disturb the natural fall of the ink based on its gravity.

However, recent printers, the sizes of which tend to be reduced, may limit the space in which the ink receiving portion is installed. Specifically, a sheet feeding mechanism, a head cleaning mechanism, and the like are arranged within the range of the path along which a carriage executes scanning. Accordingly, the need to avoid the interference between these mechanisms and the ink receiving portion makes it difficult to design the channel through which ink is guided from the ink receiving portion to the waste ink absorbing portion as well as the shape of the ink receiving portion. For example, the ink receiving portion may have to be partly constricted; the ideal design may be impossible.

Thus, in an ink jet printing apparatus using ink less soluble than the conventional ink, the less soluble ink may accumulate in the ink receiving portion or a channel. As a result, the deposit may block the channel. In this case, the deposit may disadvantageously overflow or contact the ejection opening formed surface. The term called deposit here means what mainly color material and ink solvent or the like solidify.

Japanese Patent Laid-Open No. 7-323574 discloses means for solving these problems, that is, a mechanism that scrapes off adhering deposit.

Japanese Patent Laid-Open No. 9-30004 discloses an operation of removing deposit onto the ink receiving portion which operation is different from the ejection operation serving as the recovering operation for the print head.

Japanese Patent Laid-Open No. 2003-72106 discloses a technique of dividing a spit position into plural positions and preliminarily ejecting ink so that the ink is distributed to the respective spit positions to reduce the height of the ink heap.

However, the technique disclosed in Japanese Patent Laid-Open No. 7-323574 disadvantageously increases the width of the printing apparatus and the number of components to complicate the mechanism and control. This prevents size and cost reduction.

Further, the technique disclosed in Japanese Patent Laid-Open No. 9-30004 carries out ink ejection to remove deposit independently of the preliminary ejection for the recovering operation for the print head. This disadvantageously increases ink consumption and thus running costs.

Further, Japanese Patent Laid-Open No. 2003-72106 discloses a technique for performing a spit operation at a certain spit position and performing the next spit operation at a different spit position. This technique is effective in varying the ink spitting position to disperse the deposit in the ink receiving portion without concentrating it in one area to reduce its height. However, this technique does not remove the deposit itself. In other words, ink is spat at different positions to reduce the height of the ink deposit. Accordingly, this is not a measure for suppressing the deposit generation itself. Therefore, if preliminary ejection is frequently carried out or viscous ink is used, the amount of ink deposit itself apparently increases.

SUMMARY OF THE INVENTION

In view of the conventional problems, an object of the present invention is to provide an ink jet printing apparatus and the like which can suppress an increase in ink consumption using an inexpensive configuration without the need for a complicated mechanism or control and which can control the amount of deposit in a preliminary receiving portion.

To accomplish this object, the present invention has a configuration described below.

A first aspect of the present invention provides an ink jet printing apparatus comprising ejection control means for scanning printing means that ejects ink in a direction orthogonal to a direction in which a print medium is conveyed, while ejecting ink from the printing means onto the print medium, and ejecting ink from the printing means into an ink receiving portion provided at a position where the ink receiving portion can lie opposite the printing means, characterized in that the printing means has a first ink ejecting portion and a second ink ejecting portion which are sequentially disposed along the scanning direction, the first ink ejecting portion ejects ink that accumulates more easily than ink ejected from the second ink ejecting portion, and the ejection control means allows the ink ejected from the first ink ejecting portion and the ink ejected from the second ink ejecting portion to land on the ink receiving portion in an overlapping manner, and is able to change the position where the inks ejected from both ink ejecting portions land on the ink receiving portion in an overlapping manner.

A second aspect of the present invention provides a recovery method for an ink jet printing apparatus in which after a print head having an ink ejecting portion is moved to a predetermined ink receiving portion, the ejecting portion ejects ink into the ink receiving portion to recover ejecting performance of the ejecting portion, characterized by comprising a step of changing a position where easily accumulating ink ejected from the ink ejecting portion lands on the ink receiving portion.

A third aspect of the present invention provides a recovery method for an inkjet printing apparatus in which after a print head having a plurality of ink ejecting portions is moved to a predetermined ink receiving portion, the plurality of ejecting portions eject ink into the ink receiving portion to recover ejecting performance of the ejecting portions, characterized by comprising a step of allowing ink that accumulates easily in the ink receiving portion and ink that is hard to accumulate in the ink receiving portion to land on the ink receiving portion in an overlapping manner and a step of changing a position where the easily accumulating ink and the hard-to-accumulate ink land on the ink receiving portion in an overlapping manner.

If the ink ejected into the ink receiving portion during a recovery operation of the print head accumulates easily, the present invention changes the position where the easily accumulating ink lands on the ink receiving portion. This enables the ink accumulation state to be disturbed in the ink receiving portion. As a result, the ink receiving portion is efficiently used. Consequently, the present invention enables the ink receiving member to be used for a long time without any mechanism that scrapes off deposit as in the case of the prior art. Thus, the present invention enables an appropriate apparatus to be inexpensively constructed and running costs to be reduced.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

First Embodiment

Figure 1:
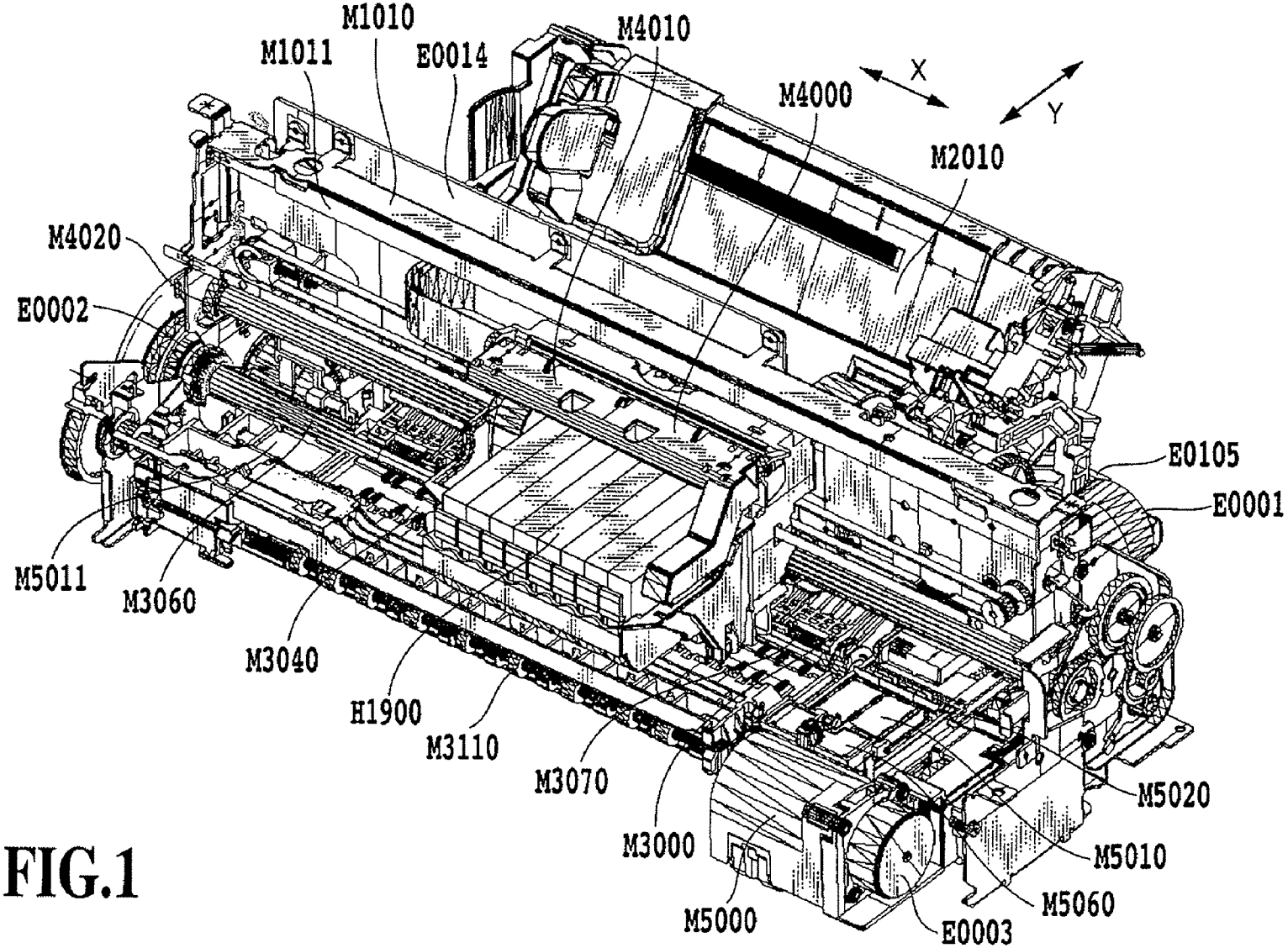
FIG. 1 is a perspective view showing the internal mechanism of an ink jet printing apparatus that is applied to a first embodiment of the present invention.

FIG. 1 is a perspective view showing an ink jet printing apparatus to which the present invention is applied according to a first embodiment and from which an outer covering portion has been removed to expose an internal mechanism. The printing apparatus main body according to the present embodiment has a sheet feeding portion, a sheet conveying portion, a sheet discharging portion, a carriage portion, a cleaning portion, and the outer covering portion. The arrangement and operation of each of these portions will be described below.

Cleaning Section

The cleaning portion cleans a print head (described below). The cleaning portion comprises a suction recovery portion including a pump M5000 and a cap M5010 that prevents the print head from being dried. The cleaning portion further comprises a wiping portion including a blade M5020 that cleans an ejection surface of the print head, and a cleaning motor E0003 that generates a driving force required to drive the wiping portion.

The cleaning motor E0003 is provided with a one-way clutch (not shown). Rotation of the cleaning motor E0003 in one direction actuates the pump M5000. Further, rotation of the cleaning motor E0003 in the other direction consecutively performs an operation of elevating or lowering the cap M5010, that is, opening or closing the ejection surface of the print head and an operation of moving the blade M5020, that is, wiping the ejection surface of the print head.

The pump M5000, actuated by the cleaning motor E0003, is formed like what is called a tube pump configured so that a pump roller squeezes an ink discharging tube connected to the cap M5010 to generate negative pressure inside the cap M5010. When the pump M5000 is actuated with the cap M5010 tightly contacted with an ejection opening formed surface of the print head, ink and bubbles or the like mixed in the ink are sucked from the print head via ink ejection openings. This allows suction recovery to be executed on the print head.

An absorbent is provided inside the cap M5010 to reduce ink remaining on the ejection opening formed surface of the print head after suction. Further, after ink is sucked from the print head, the ink remaining in the cap M5010 is sucked and removed in order to prevent possible fixation of the ink in the cap M5010 and resulting problems. This is achieved by driving the pump M5000 with the cap M5010 open, that is, with the cap M5100 open to the air. The ink sucked from inside the cap M5010 becomes waste ink. The waste ink is absorbed and held by a waste ink absorbing portion (not shown) provided in an appropriate area such as the bottom or rear surface of the apparatus.

After the above suction recovery operation, the cap M5010 lowers and leaves the ejection surface of the print head. Thus, the blade M5020 moves perpendicularly to a scanning direction of the carriage M4000 through a space formed immediately below the ejection surface, to wipe off the ejection surface of the print head. The blade M5020 comprises two components one of which cleans the vicinity of nozzles in the print head H1001 and the other of which cleans the entire ejection surface. When the carriage M4000 moves to the farthest area on the side of the apparatus on which the blade is placed, the carriage M4000 abuts against a blade cleaner M5060. This enables ink or the like adhering to the blade itself to be removed.

A print area in which a printing operation is performed on a print medium is provided at a position located opposite a scan path for the print head. A platen M3040 is provided in the print area to support the print medium. An ink receiving portion M5011 that receives preliminarily ejected ink is provided at one side end of the platen M3040, that is, at a position offset from a passing area for the print medium. An absorbent is accommodated in the ink receiving portion to receive the preliminarily ejected ink. The waste ink absorbing portion (not shown) is provided below the absorbent. An opening is formed in the ink receiving portion M5011 at a position corresponding to the waste ink absorbing portion. Ink absorbed by the absorbent in the ink receiving portion M5011 as a result of preliminary ejection flows down through the opening onto the waste ink absorbing portion.

Other Mechanisms

The sheet feeding portion separates a print medium from the other print media stacked on a platen M2010 and feeds the separated print medium to the platen M3040. The sheet conveying portion has a roller pair comprising a conveying roller M3060 and a pinch roller M3070 provided opposite the conveying roller M3060, and a conveying motor E0002 serving as a driving source for the conveying roller M3060. The roller pair conveys the fed print medium to the print area for the print head while sandwiching it between the rollers. The sheet discharging portion has a sheet discharging roller M3110 that allows the print medium to be discharged from the print area and a plurality of spur rollers that cooperate with the sheet discharging roller M3010.

The carriage portion has a carriage M4000 on which the print head is mounted. The carriage M4000 is supported by a guide shaft M4020 and a guide rail M1011. The guide shaft M4020 guides and supports the carriage M4000 so that carriage M4000 is scanned forward and backward in a direction perpendicular to the conveying direction (Y direction) of the print medium. The carriage M4000 is driven via a timing belt M4041 by a carriage motor E0001 mounted on a chassis M1010.

If the above configuration forms an image on a print medium, the print head and the print medium are positioned as described below. In the column direction of the image, the print head and the print medium are positioned by the roller pair by conveying the print medium; the roller pair comprises the conveying roller M3060 and the pinch roller M3070. Further, in the row direction of the image, the relative positions of the print head and the print medium are determined by the carriage motor E0001 by moving the carriage M4000 in the direction perpendicular to the conveying direction. This positions the print head at an intended image forming position. The positioned print head ejects ink to the print medium in accordance with a signal from an electric control circuit board E0014. The print head will be described below in detail. With the printing apparatus of the present embodiment, the print head carries out printing, while main scan and sub-scan are alternated; in the main scan, the carriage M4000 is moved in the column direction, and in the sub-scan, the conveying roller M3060 conveys the print medium in the row direction.

Print Head

Figure 2:
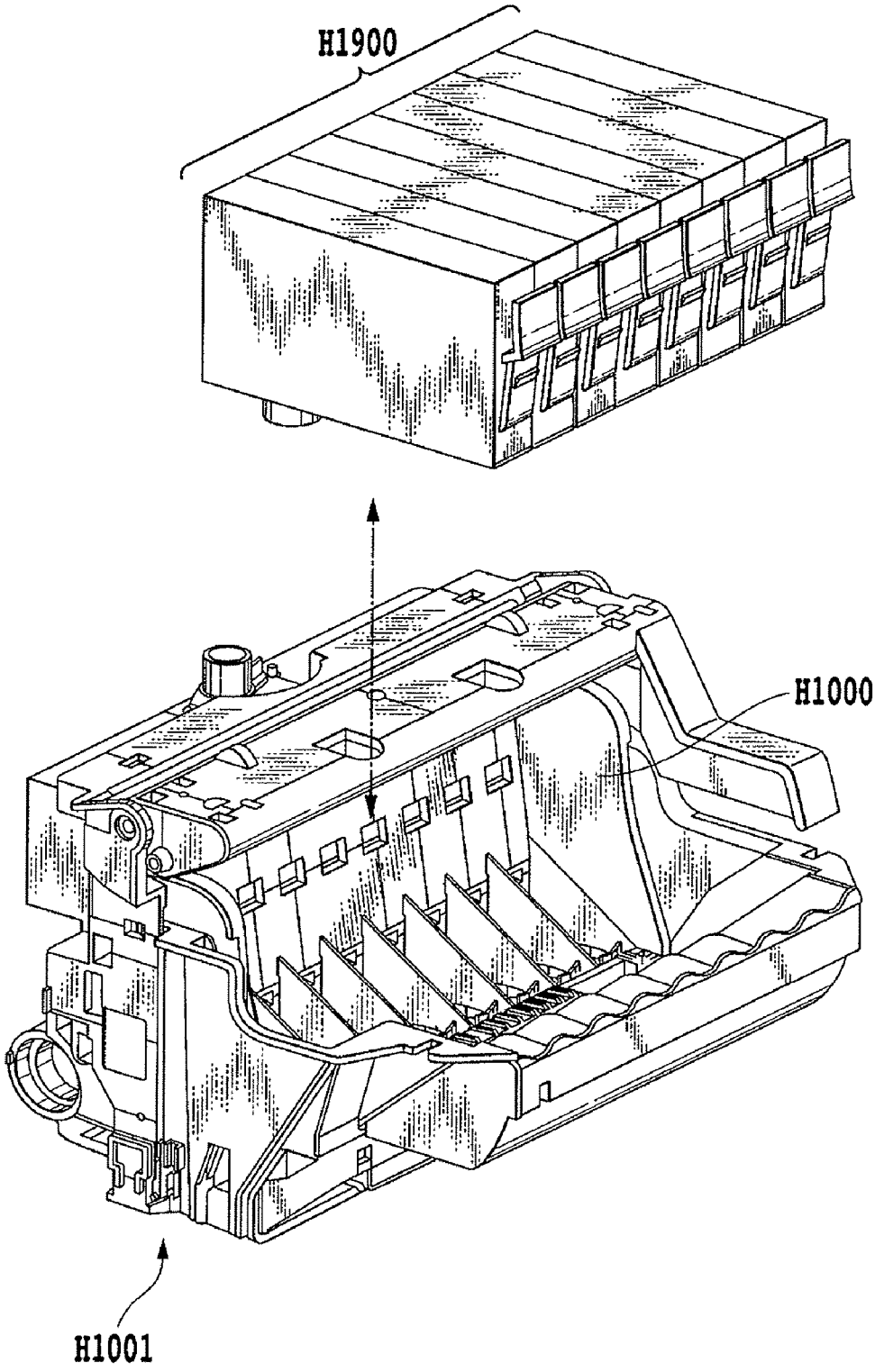
FIG. 2 is a perspective view showing how an ink tank is installed in a head cartridge that is applied to the first embodiment of the present invention.

Now, with reference to FIG. 2, description will be given of configuration of a head cartridge H1000 to which the present invention is applied according to the present embodiment. The head cartridge H1000 according to the present embodiment has the print head H1001, mounting means for the ink tank H1900, and means for supplying ink from the ink tank H1900 to the print head. The head cartridge H1000 is removably mounted on the carriage M4000. FIG. 2 shows how the ink tank H1900 is installed in the head cartridge H1000.

The printing apparatus of the present embodiment forms images using eight color inks. Thus, eight differently configured ink tanks H1900 are provided for the respective colors. These ink tanks can be freely installed in and removed from the head cartridge H1000. The ink tanks H1900 can be installed in and removed from the head cartridge H1000 remaining mounted on the carriage M4000.

Figure 3:
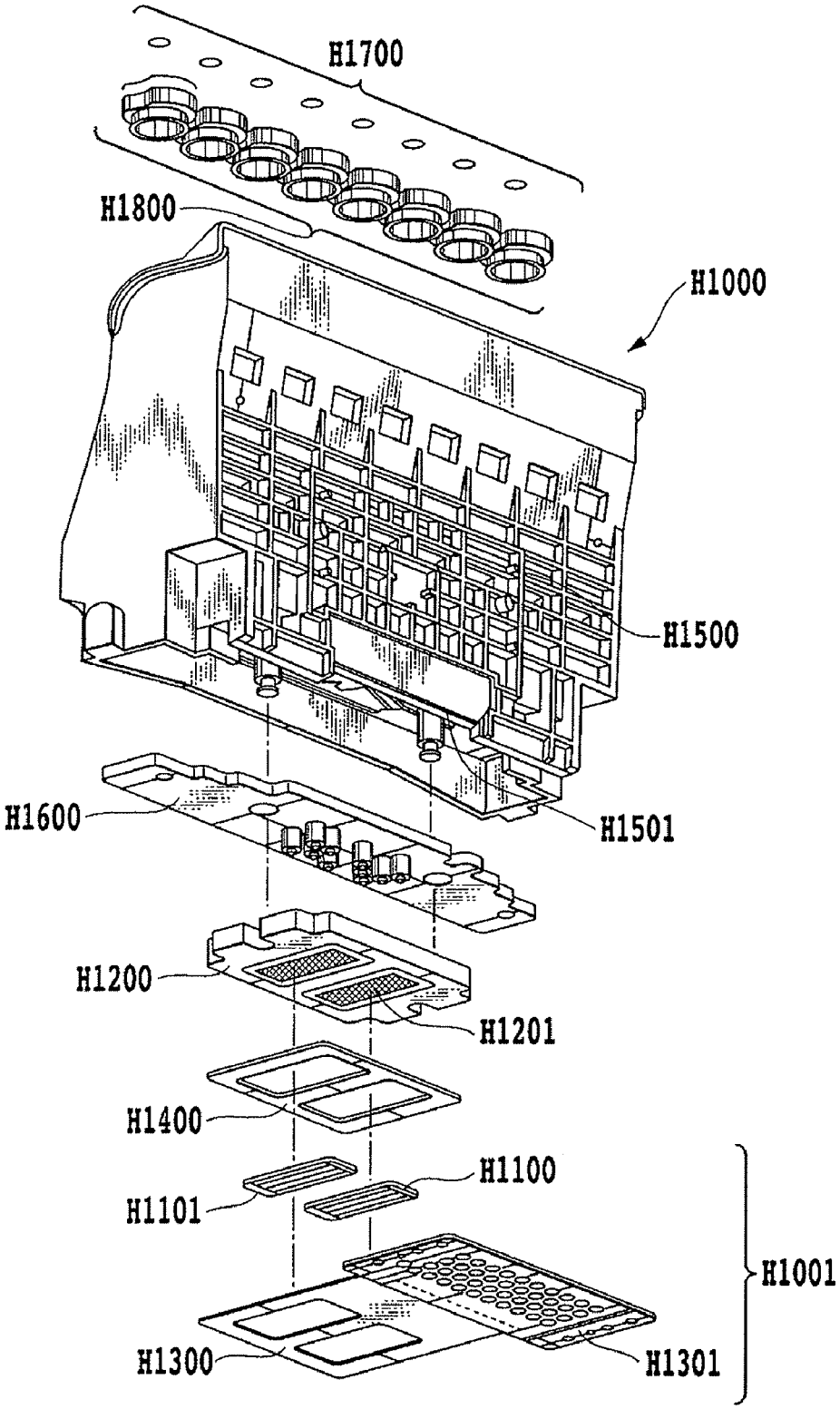
FIG. 3 is an exploded perspective view of the head cartridge that is applied to the first embodiment of the present invention.

FIG. 3 is an exploded perspective view of the head cartridge H1000. In the figure, the head cartridge H1000 has a first print element circuit board H1100 and a second print element circuit board H1101, a first plate H1200, a second plate H1400, and an electric wiring circuit board H1300. The head cartridge H1000 further has a tank holder H1500, a channel forming member H1600, a filter H1700, and seal rubber H1800; these components constitute the head cartridge H1000.

The first print element circuit board H1100 and the second print element circuit board H1101 are made of Si and each have a plurality of print elements (nozzles) formed on one surface by a photolithography technique to eject ink. Electric wiring made of Al or the like is formed by a film forming technique; through the electric wiring, power is supplied to each print element. A plurality of ink channels corresponding to the individual print elements are also formed by the lithography technique. Moreover, ink supply ports are formed in the back surface of the circuit board to supply ink to the plurality of ink channels.

A line of print elements (hereinafter referred to as a nozzle line) corresponding to the different ink colors is composed of 768 nozzles arranged at intervals of 1200 dpi (dot/inch; reference value) in the conveying direction of the print medium. About 2 picolitter of ink droplet is ejected from each nozzle. The opening area of each nozzle ejection opening is set at about 100 $\mu m^2$. The first print element circuit board H1100 and the second print element circuit board H1101 are fixedly bonded to the first plate H1200. Ink supply ports H1201 are formed in the first plate H1200 to supply ink to the first print element circuit board H1100 and second print element Circuit board H1101.

A second plate H1400 having openings is fixedly bonded to the first plate H1200. The second plate H1400 holds the electric wiring circuit board H1300 so as to electrically connect the electric wiring board H1300, first print element circuit board H1100, and second print element circuit board H1101 together.

The electric wiring circuit board H1300 applies electric signals to the first print element circuit board H1100 and second print element circuit board H1101 to eject ink from the nozzles formed in these circuit boards H1100 and H1101. The electric circuit board H1300 has electric wiring corresponding to the first print element circuit board H1100 and second print element circuit board H1101, and an external signal input terminal H1301 positioned at an end of the electric wiring to receive electric signals from the printing apparatus main body. The external signal input terminal H1301 is fixedly positioned close to a rear surface of a tank holder H1500.

A channel forming member H1600 is fixed by, for example, ultrasonic welding to the tank holder H1500, which holds the ink tank H1900. The channel forming member 1600 forms an ink channel H1501 from the ink tank H1900 to the first plate H1200. A filter H1700 is provided at an ink tank side end of the ink channel H1501 which engages with the ink tanks H1900. The filter H1700 prevents the entry of external dust. Seal rubber H1800 is also installed in the engaging portion between the ink channel H1501 and the ink tank H1900 to prevent ink from evaporating from the engaging portion.

The head cartridge H1000 is constructed by uniting the tank holder portion with the print head portion H1001 by bonding or the like. The tank holder portion is composed of the tank holder H1500, the channel forming member H1600, the filter H1700, and the seal rubber H1800. The print head portion H1001 is composed of the first print element circuit board H1100, second print element circuit board H1101, first plate H1200, electric wiring circuit board H1300, and second plate H1400.

Figure 4:
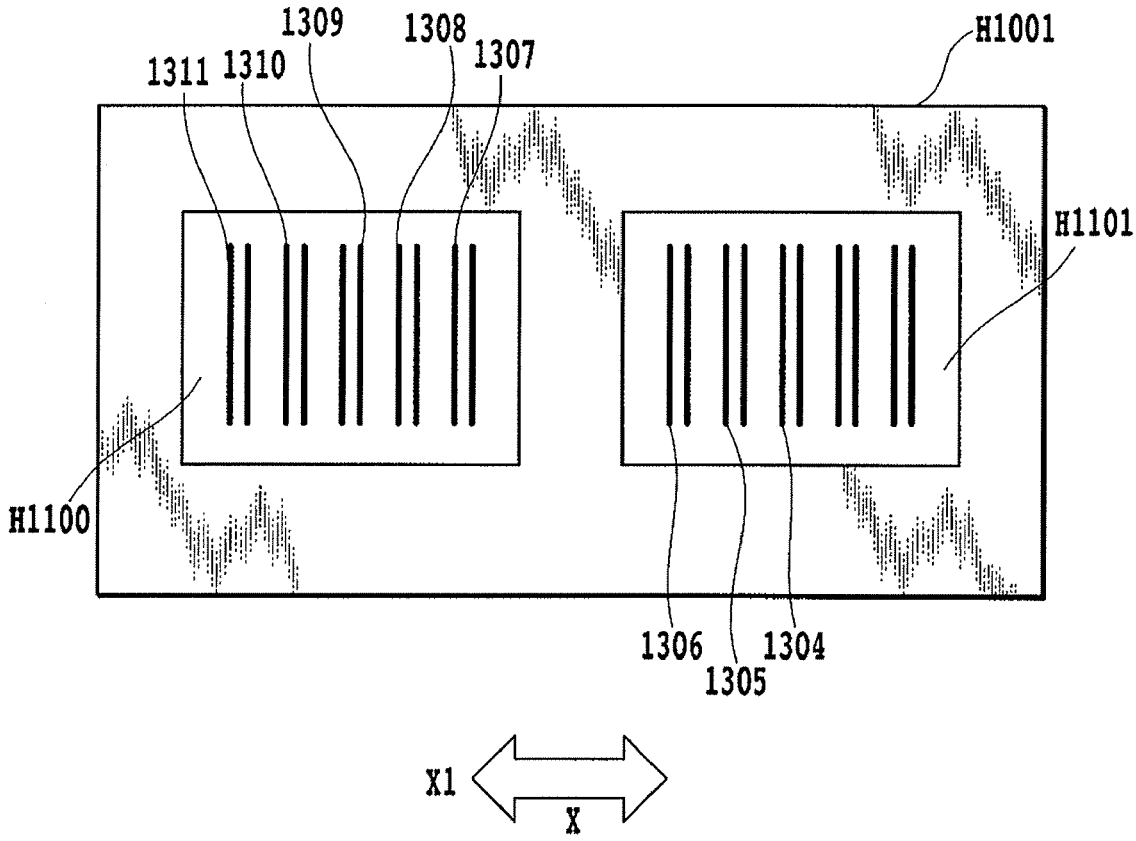
FIG. 4 is a diagram showing the arrangement of a nozzle group in a print head in a first embodiment of the present invention.

FIG. 4 shows the arrangement of a nozzle group in a print head according to the first embodiment of the present invention.

The print head according to the first embodiment has a first print head portion having the ability to execute high-speed full-color printing and a second print head portion having the ability to execute high-quality printing. The first print head portion corresponds to the first print head circuit board H1101. The second print head portion corresponds to the second print head circuit board H1100.

The first head portion H1101 has ejecting portions (second ejecting portions) 1304, 1305, and 1306 that eject yellow ink, magenta ink, and cyan ink, which are three primary color materials required to reproduce full colors by subtractive color mixture. The ejecting portions are arranged in a direction different from the scanning direction (X direction) of the print head H1101 (for example, the conveying direction of the print medium (Y direction), which is substantially perpendicular to the scanning direction) to constitute a nozzle line. Two nozzle lines are formed for each color. The two nozzle lines are separated from each other at a ½ pitch in the conveying direction. In the figure, the two ejecting portions (each including two lines) shown to the right of the ejecting portion 1304 are unused according to the present embodiment.

The second print head portion H1100 has ejecting portions 1307 and 1309 that eject light cyan ink and light magenta ink to improve the gradation of output images. An ejecting portion 1308 is also formed in the second print head portion H1100 to eject black ink in order to improve the contrast of output images. In the present embodiment, ejecting portions 1301 and 1311 serving as first ejecting portions are also formed which eject respective types of special inks (special ink 1 and special ink 2) to enable the reproduction of a gamut that cannot be reproduced only with the three primary colors of the cyan, magenta, and yellow color materials. Also in the second print head portion H1100, each of the ejecting portions 1307 to 1311 is composed of two nozzle lines as in the case of the first print head portion H1101.

Configuration of Control System for the Ink Jet Printing Apparatus

Now, a control system in the present embodiment will be described.

Figure 5:
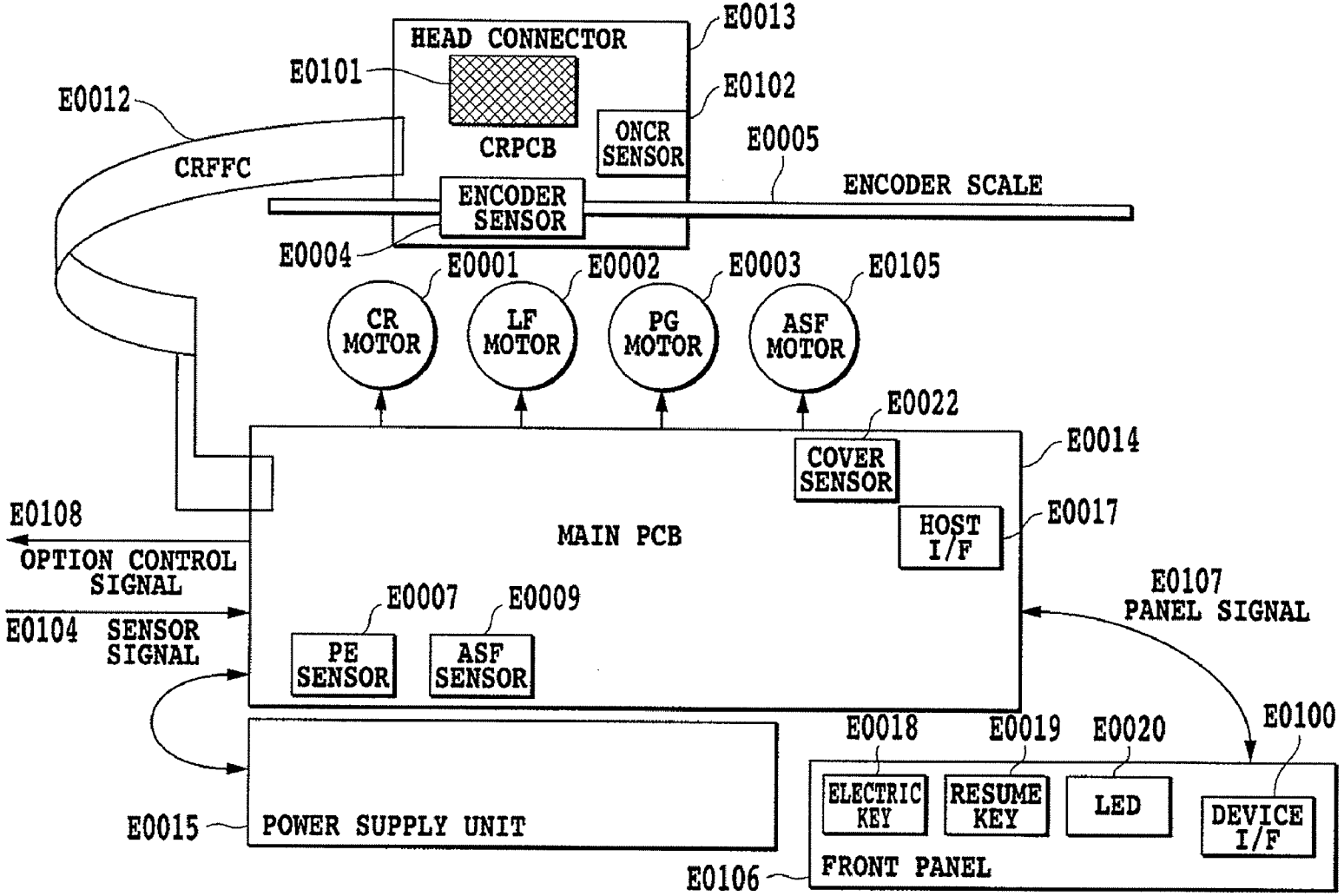
FIG. 5 is a block diagram generally illustrating the entire configuration of a control system according to the embodiments of the present invention.

FIG. 5 is a block diagram schematically illustrating the general configuration of the control system in the present embodiment of the present invention.

The printing apparatus to which the present invention is applied according to the present embodiment is mainly composed of a carriage circuit board (CRPCB) E0013, a main PCB (Printed Circuit Board) E0014, a power supply unit E0015, and a front panel E0106. The power supply unit E0015 is connected to the main PCB E0014 to provide each driving power supply.

The carriage circuit board E0013 is a printed circuit board unit mounted on the carriage M4000. The carriage circuit board E0013 functions as an interface that transmits signals to and from the print head H1001 through a head connector E0101. On the basis of a pulse signal output by an encoder sensor E0004 in synchronism with movement of the carriage M4000, the carriage circuit board E0013 detects a change in the positional relationship between the encoder scale E0005 and the encoder sensor E0004. The carriage circuit board outputs a signal to the main PCB E0014 through a flexible flat cable (CRFFC) E0012. The carriage circuit board E0013 has a temperature sensor such as a thermistor which detects ambient temperature and an appropriate optical sensor. Information obtained by these sensors (OnCR) E0102 is output to the main PCB E0014 through the flexible flat cable (CRFFC) E0012 together with head temperature information from a temperature sensor (not shown) provided in the print head cartridge H1000.

The main PCB E0014 is a printed circuit board unit that drivingly controls each portion of the ink jet printing apparatus according to the present embodiment. The circuit board has a CPU serving as control means for performing various types of control including suction recovery operation control described with reference to FIG. 9, and a ROM in which programs executed by the CPU are stored. The main PCB E0014 has a sheet end detecting sensor (PE sensor) E0007, an automatic sheet feeder (ASF) sensor E0009, a cover sensor E0022, and a host interface (host I/F) E0017. The main PCB E0014 connects to the carriage motor E0001, which serves as a driving source for the main scan of the carriage M4000, an LF motor E0002 serving as a driving source for conveyance of the print medium, and a motor E0003 serving as a driving source for an operation of recovering the print head H1001. The main PCD E0014 further connects to an ASF motor E0105 serving as a driving source for a print medium feeding operation. The main PCD E0014 controls the driving of these motors and thus the driving of the corresponding functions. The main PCB E0014 also receives various sensor signals E0104 indicative of the installation and operation statuses of various option units such as an ink empty sensor, a media (paper) determining sensor, a carriage position (height) sensor, an LF encoder sensor, and a PG sensor. To drivingly control these option units, the main PCB E0014 outputs an option control signal E0108. The main PCB E0014 also connects to the CRFFC E0012, power supply unit E0015, and front panel E0106. The main PCB E0014 further has an interface that transmits and receives information via a panel signal E0107.

The front panel E0106 is a unit provided on the front surface of the printing apparatus main body to facilitate user operations. The front panel E0106 has a resume key E0019, a LED E0020, a power supply key E0018, and a device I/F E0100 used to connect to a peripheral device such as a digital camera.

Preliminary Ejection Operation Sequence for the Ink Receiving Section

FIGS. 6A to 6E schematically show a basic preliminary ejection operation sequence on the ink receiving portion M5011. In FIGS. 6A to 6E, the print head H1001 is shown in a side view in order to illustrate how ejection from the print head H1011 is carried out. However, the ink receiving portion M5011 is shown in a plan view in order to illustrate how ink ejected from the print head lands on a print medium.

The special color ink 2, corresponding to the ejecting portion 1311 (see FIG. 4) of the print head H1001, contains a less soluble color material than the seven other color inks. The special color ink 2 can be re-dispersed by mixing it with any of the seven other color inks but may be difficult to re-disperse depending on the environment.

The carriage M4000 scans toward the ink receiving portion M5011 (in an X1 direction). Once the print head portion H1100 of the print head H1001 reaches a position over the ink receiving portion M5011, the ejecting portion 1311 preliminarily ejects the special color ink 2 onto the ink receiving portion M5011 (see FIG. 6A).

Then, when the print head H1001 moves further in the X1 direction together with the carriage M4000, the ejecting portion 1310 preliminarily ejects ink onto the ink receiving portion M5011. This preliminary election is executed at a timing such that the ink lands on the same position on the ink receiving portion 5011 as that already landed by the special color ink 2 (see FIG. 6B).

The carriage M4000 subsequently moves further in the X1 direction. The ejecting portion 1309 preliminarily ejects light magenta ink onto the ink receiving portion 5011 at a timing such that the light magenta ink lands on the same position on the ink receiving portion 5011 as that already landed by the above two inks (see FIG. 6C).

Figure 6A:
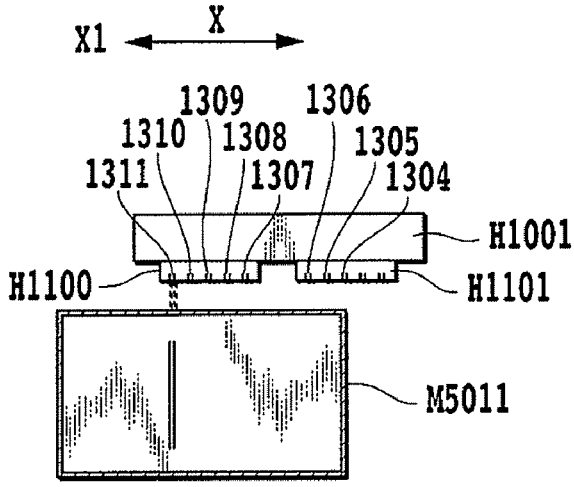
FIGS. 6A to 6E are diagrams schematically showing a basic preliminary ejection operation sequence executed on an ink receiving portion.
Figure 6B:
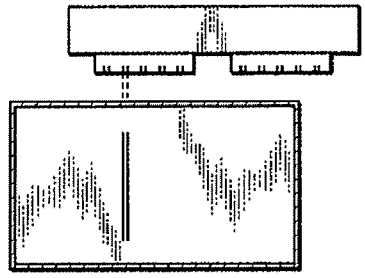
Figure 6C:
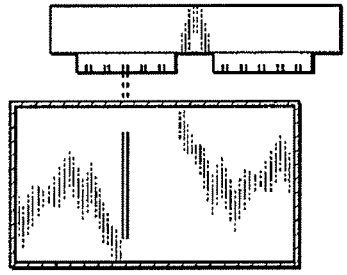
Figure 6D:
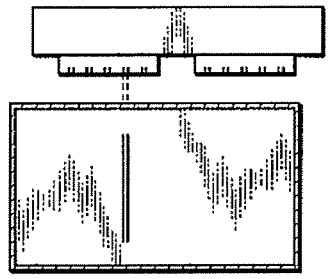
Figure 6E:
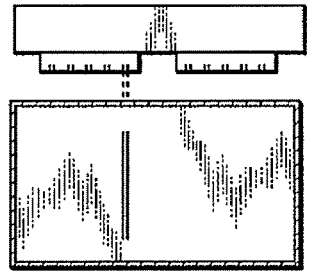

As the carriage M4000 moves, the ejecting portion 1308 ejects black ink (see FIG. 6D). The ejecting portion 1307 preliminarily ejects light cyan ink at a timing such that the light cyan ink lands on the same position as that landed by the last ink (see FIG. 6E).

These preliminary ejecting operations allow the five color inks supplied to the print head portion 1303 to be preliminarily ejected onto the ink receiving portion M5011 so as to sequentially overlap one another.

FIGS. 7A to 7E schematically show a preliminary ejection operation on the ink receiving portion M5011 according to the first embodiment of the present invention. The preliminary ejection operation sequence in FIGS. 7A to 7E is based on the basic preliminary ejection operation sequence in FIGS. 6A to 6E.

The preliminary ejecting operation performed on the ink receiving portion M5011 involves counting ejections of the ink from one nozzle in the ejecting portion 1311 of the print head H1001.

Figure 7A:
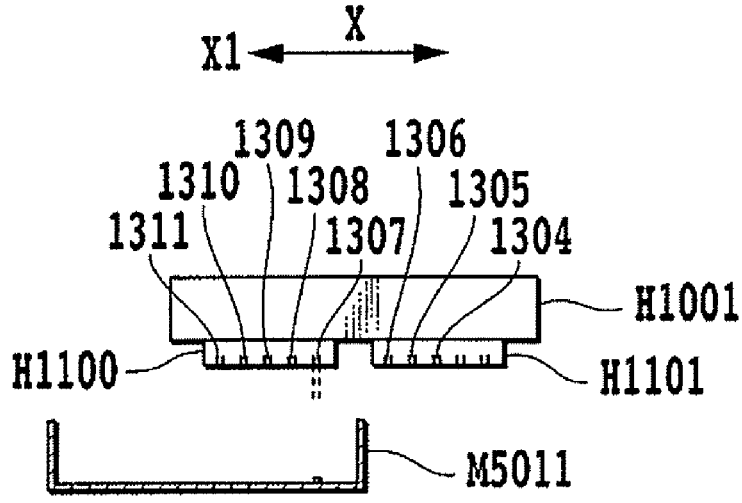
FIGS. 7A to 7E are diagrams schematically showing a preliminary ejection operation sequence according to the first embodiment of the present invention.
Figure 7B:
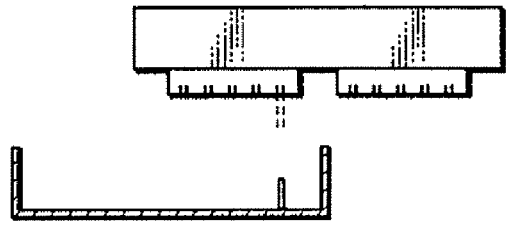
Figure 7C:
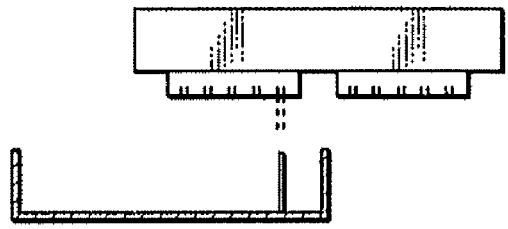
Figure 7D:
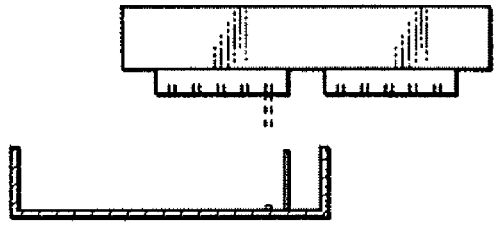
Figure 7E:
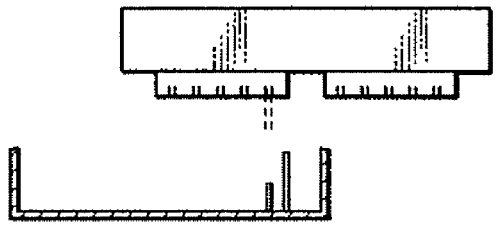
Figure 8A:
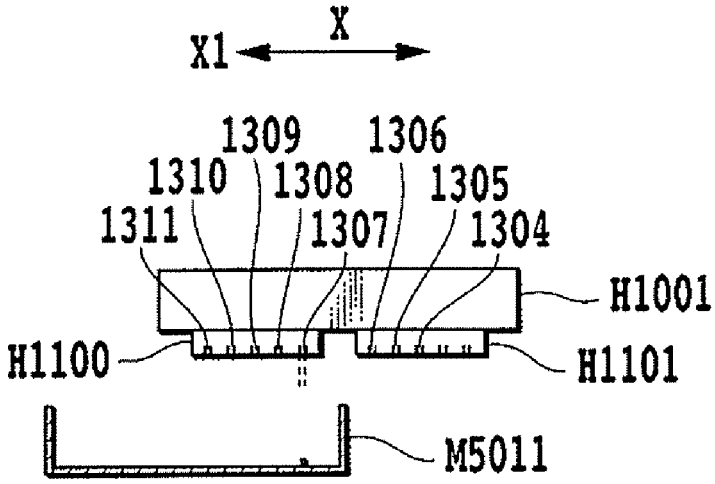
FIGS. 8A to 8E are diagrams schematically showing a preliminary ejection operation sequence according to a second embodiment of the present invention.
Figure 8B:
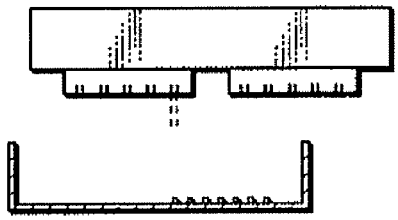
Figure 8C:
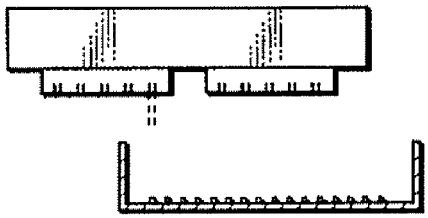
Figure 8D:
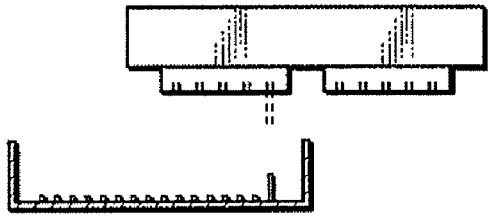
Figure 8E:
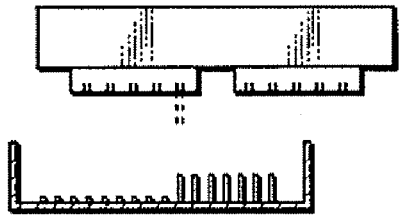

The carriage M4000 scans toward the ink receiving portion 5011 (X1 direction), and the print head portion H1100 of the print head H1001 reaches the ink receiving portion M5011. Then, the five color inks are preliminarily ejected so as to sequentially overlap one another in the ink receiving portion M5011. In other words, the ejecting portions 1311 to 1307 sequentially execute preliminary ejections that target the same position in the ink receiving portion M5011. FIG. 7A shows the fifth preliminary ejection during this scan, that is, the preliminary ejection from the ejecting portion 1307.

The special color ink 2, corresponding to the ejecting portion 1311 (see FIG. 4) of the print head H1001, contains a less soluble (more easily accumulating) color material than the seven other color inks. Because of high likelihood of accumulation of the special color ink 2, repeated preliminary ejections gradually accumulate the special color ink 2 in the ink receiving portion M5011 (see FIG. 7B). When the ejection count reaches $3\times10^8$, the ink deposit reaches the vicinity of ejection opening formed surface of the print head H1001 (see FIG. 7C).

Then, the ejection count, on the ink receiving portion M5011, for one specific nozzle in the ejecting portion 1311 of the print head H1001 is reset to zero. The subsequent preliminary ejecting operation is performed at a position which is different and slightly away from the last ejection position. This allows the five color inks to be preliminarily ejected again so as to sequentially overlap one another (see FIG. 7D). At the same time, the ejection count is resumed. Preliminary ejections are subsequently repeated to gradually accumulate the ink in the ink receiving portion M5011 again (see FIG. 7E).

When a preliminary ejecting operation is repeatedly performed at different positions in the ink receiving portion M5011 as described above, deposit is distributively formed at different positions in the ink receiving portion M5011. Thus, even if easily accumulating ink must be used, the deposit is controlled to enable a print head recovery operation to be always stably performed.

The yellow ink, magenta ink, and cyan ink ejected from the print head portion H1101 are also preliminarily ejected onto the ink receiving portion M5011. In this case, these three color inks can also be allowed to land on the same position as that landed by the five other color inks. However, the accumulation of the special color ink 2 in the ink receiving portion M5011 can be reduced to some degree by ejecting the four other color inks in an overlapping manner. Further, to avoid a decrease in the throughput of the printing apparatus, it is necessary to minimize the movement of the carriage. Accordingly, the above three color inks are preliminarily ejected without moving the print head H1001. That is, to allow the three color inks to land on the print medium so that the three color inks overlap the four other color inks, it is necessary to move the second print head H1100 in a direction in which the print head H1100 leaves the print area (in the X1 direction). This increases the movement of the carriage to affect the throughput. Thus, to reduce the movement of the carriage, minimum required amounts of inks are allowed to overlap one another during preliminary ejections.

Timings for ink ejections from the print head are controlled by the CPU in the main PCB E0014 via a driving circuit for the print head on the basis of an output from the encoder sensor E0004 which indicates the position of the carriage M4000. Specifically, the CPU determines whether or not the ejecting portions for less soluble inks and the ejecting portions for more soluble inks that are ejected so as to overlap the above inks have reached a predetermined position in the ink receiving portion. This determination is made on the basis of the position of the carriage M4000 indicated by a signal from the encoder sensor E0004. When each ejecting portion reaches the predetermined position in the ink receiving portion, preliminary ejection is executed. This enables the inks ejected from the plurality of ejecting portions to be ejected to the same position in the ink receiving portion M5011 in an overlapping manner.

The present embodiment focuses on the number of preliminary ejections from one nozzle for each color. When the number exceeds a predetermined threshold, the landing position is changed. Then, if the threshold is exceeded again at a new position, the landing position is further changed. However, in this example, ink deposit is likely to occur at earlier preliminary ejection positions, considering a viewpoint with time. Thus, if the threshold is exceeded at all the landing positions, control may be performed such that the position is sequentially changed toward the initial preliminary ejection position. Specifically, the landing position is sequentially changed along the X1 direction (first scanning direction) as shown in FIGS. 7A to 7E. When the landing position reaches the left end of the ink receiving portion, the landing position may be sequentially changed along a direction (second scanning direction) opposite to the X1 direction, starting from the left end.

Second Embodiment

Now, a second embodiment of the present invention will be described.

FIGS. 8A to 8E schematically show a preliminary ejecting operation sequence on the ink receiving portion M5010 according to the second embodiment of the present invention. The preliminary ejection operation sequence in FIGS. 8A to 8E is based on the basic preliminary ejection operation sequence in FIGS. 6A to 6E.

The present embodiment also counts ejections from each nozzle in the ejecting portion 1311 of the print head H1001 during a preliminary ejecting operation on the ink receiving portion M5011. The special color ink 2, corresponding to the ejecting portion 1311 (see FIG. 4) of the print head H1001, contains a less soluble color material than the seven other color inks. The special color ink 2 is thus difficult to redisperse even when mixed with any of the seven other color inks and accumulates very easily.

The carriage M4000 scans toward the ink receiving portion M5011 (in an X1 direction). Once the print head portion H1303 of the print head H1001 reaches a position over the ink receiving portion M5011, the five color inks are preliminarily ejected so as to sequentially overlap one another (see FIG. 8A).

When the print head portion H1303 of the print head H1001 reaches the position over the ink receiving portion M5011, the five color inks are preliminary ejected so as to sequentially overlap one another at a position slightly away from the last preliminary ejection position. This operation is repeated (see FIG. 8B). That is, the second embodiment ejects the ink to a different position in the ink receiving portion M5011 every time scan is carried out for preliminary ejection. As a result, deposits are formed in the ink receiving portion M5011 while being equalized (see FIGS. 8C to 8E).

Thus, even if very easily accumulating ink must be used, the deposit can receive ink by fully utilizing the area of the ink receiving portion M5011. This enables the ink receiving portion M5011 to last longer, allowing running costs to be reduced.

Other Embodiments

With the ink set according to the above embodiments, inks of different color tones contact and mix with one another in the ink receiving portion. Thus, the inks preferably do not react to one another when mixed with one another. That is, no reaction preferably occurs with the ink set including at least the black ink, light cyan ink, light magenta ink, and special inks 1 and 2. However, no problems occur if a plurality of the inks facilitate accumulation or accumulate easily.

Provided that even the contact or mixture of different types of inks does not affect the ink absorbing performance or maintainability of the ink receiving portion, dye-containing inks or pigment-containing inks are applicable. Moreover, the color tones used are not particularly limited. Further, if plural types of inks are used which react to one another to exert an adverse effect depending on their combination, less soluble inks are selected to avoid reaction in spite of contact or mixture and are ejected to the same position in the ink receiving portion.

During preliminary ejection, the first embodiment counts the amount of ink ejected from one nozzle in the nozzle ejecting portion that ejects easily accumulating ink and then determines on the basis of the count whether or not to change the ink landing position in the ink receiving portion. A precondition for this operation is that during preliminary ejection, the ink is ejected from all the nozzles in each ink ejecting portion. However, some preliminary ejecting schemes counts ink ejections from all the nozzles in the ejecting portion and executing preliminary ejection only on nozzles with smaller ejection amounts. For these preliminary ejecting schemes, ejections from all the nozzles in the ejecting portion may be counted during preliminary ejection so that when one or more counts reach a given value, the landing position in the ink receiving portion can be changed.

In the above description, the ink that accumulates easily in the ink receiving portion and the ink that is hard to accumulate in the ink receiving portion are ejected to substantially the same landing position in the ink receiving portion. This enables the accumulation of the ink in the ink receiving portion to be reduced. However, the present invention is not limited to this. The present invention is also effective on such an ejection method as avoids allowing hard-to-accumulate ink and easily accumulating ink to overlap each other upon landing on a print medium. That is, the present invention allows hard-to-accumulate ink to land on different positions in the ink receiving portion to prevent the ink from accumulating in a certain area of the ink receiving portion in a concentrated manner. Therefore, even if hard-to-accumulate ink and easily accumulating ink are allowed to land on different positions, the initial object of the present invention can be achieved by changing the landing position of the hard-to-accumulate ink in the ink receiving portion.

The present invention is not limited to the above embodiments in terms of the types (color tones) or number of ejecting portions, the number or order of overlapping colors, the preliminary ejection position, the number of changes in the preliminary ejection position, or the number of ejections executed until the preliminary ejection position is changed. These can be appropriately changed with a reduction in the size and cost of the apparatus taken into account.

While the present invention has been described with reference to exemplary embodiments, it is to be understood that the invention is not limited to disclosed exemplary embodiments. The scope of the following claims is to be accorded the broadest interpretation so as to encompass all such modifications and equivalent structures and functions.

This application claims the benefit of Japanese Patent Application No. 2005-321011, filed Nov. 4, 2005, which is hereby incorporated by reference herein in its entirety.

What is claimed is:

1. An ink jet printing apparatus, comprising:

printing means for ejecting ink onto a print area of a print medium, and for ejecting ink into a receiving portion provided at a position adjacent to the print area; and ejection control means for scanning the printing means in a scanning direction orthogonal to a direction in which a print medium is conveyed, while controlling election of ink from the printing means onto the print area and into the ink receiving portion, wherein the printing means has a first ink ejecting portion and a second ink ejecting portion, which are sequentially disposed along the scanning direction, the first ink ejecting portion ejects ink which is re-dispersable, and that accumulates more easily than ink ejected from the second ink ejecting portion, the second ink ejecting portion ejecting ink which re-disperses components of ink ejected from the first ejecting portion, the ejection control means allows the ink ejected from the first ink ejecting portion and the ink ejected from the second ink ejecting portion to land on the ink receiving portion in an overlapping manner, and is able to change a landing position where the inks ejected from both the first and second ink ejecting portions land on the ink receiving portion in an overlapping manner, and the ejection control means changes the landing position of the easily accumulating ink in the ink receiving portion when an amount of the easily accumulating ink in the ink receiving portion reaches a preset threshold which is larger than an amount of one droplet of ink, and allows the easily accumulating ink to sequentially accumulate beginning at a position nearest to the print area in the ink receiving portion until the amount of the easily accumulating ink reaches the preset threshold.

2. The ink jet printing apparatus according to claim 1, wherein the ejection control means changes the landing position of the easily accumulating ink in the ink receiving portion to a position different from a last position when a number of ejections of the easily accumulating ink into the ink receiving portion reaches a predetermined threshold.

3. The ink jet printing apparatus according to claim 1, wherein the ink receiving portion absorbs ink ejected from the print head.

4. The ink jet printing apparatus according to claim 1, wherein the ejection control means allows the ink ejected from the first ink ejecting portion to land on the ink receiving portion earlier than the ink ejected from the second ink ejecting portion.

5. A recovery method in an ink jet printing apparatus which scans printing means, which ejects ink, in a scanning direction orthogonal to a direction in which a print medium is conveyed, while ejecting ink from the printing means onto a print area of the print medium, and ejects ink from the printing means into an ink receiving portion provided at a position adjacent the print area for the printing means, wherein the printing means has a first ink ejecting portion and a second ink ejecting portion, which are sequentially disposed along the scanning direction, the first ink ejecting portion ejects ink which is re-dispersable, and that accumulates more easily than ink ejected from the second ink ejecting portion, the second ink ejecting portion ejecting ink which re-disperses components of ink ejected from the first ejecting portion, said method comprising the steps of:

allowing the ink ejected from the first ink ejecting portion and the ink ejected from the second ink ejecting portion to land on the ink receiving portion in an overlapping manner; and changing a landing position where the inks ejected from both the first and second ink ejecting portions land on the ink receiving portion in an overlapping manner, wherein the landing position of the easily accumulating ink in the ink receiving portion is changed when an amount of the easily accumulating ink in the ink receiving portion reaches a preset threshold which is larger than an amount of one droplet of ink, and the easily accumulating ink is allowed to sequentially accumulate beginning at a position nearest to the print area in the ink receiving portion until the amount of the easily accumulating ink reaches the preset threshold.

* * * * *